US007691322B2

(12) United States Patent
Peel et al.

(10) Patent No.: US 7,691,322 B2
(45) Date of Patent: Apr. 6, 2010

(54) FURNACES AND METHODS OF MELTING

(75) Inventors: Alan Michael Peel, Hope Valle (GB); Roger Howitt, Swadlincote (GB)

(73) Assignee: EMP Technologies Limited (GB)

( * ) Notice: Subject to any disclaimer, the term of this patent is extended or adjusted under 35 U.S.C. 154(b) by 0 days.

(21) Appl. No.: 11/891,726

(22) Filed: Aug. 13, 2007

(65) Prior Publication Data

US 2008/0023891 A1 Jan. 31, 2008

Related U.S. Application Data

(63) Continuation of application No. 10/399,508, filed as application No. PCT/GB01/04579 on Oct. 16, 2001, now abandoned.

(30) Foreign Application Priority Data

Oct. 17, 2000 (GB) ..... 0025413.6

(51) Int. Cl.
*F27D 3/00* (2006.01)

(52) U.S. Cl. ..... 266/237; 266/900; 75/583

(58) Field of Classification Search ..... 266/200, 266/237, 900; 75/583, 594
See application file for complete search history.

(56) References Cited

U.S. PATENT DOCUMENTS 3,276,758 A * 10/1966 Burg et al. ..... 266/900

FOREIGN PATENT DOCUMENTS

| | | |
|---|---|---|
| DE | 29 03 316 A | 7/1980 |
| JP | 07268504 | 10/1995 |
| WO | WO 99 53109 A | 10/1999 |

* cited by examiner

*Primary Examiner*—Scott Kastler
(74) *Attorney, Agent, or Firm*—Fay Sharpe LLP

(57) ABSTRACT

The invention provides an improved furnace structure and methods of melting material in furnaces, particularly aimed at reducing the start up time for such furnaces. The furnace (2) defines a container for the molten metal having a maximum depth of molten metal in that container during use. A flow generator (30) for the molten metal within the furnace is fed through a first conduit (32) and supplies material back to the furnace through a second conduit (36). The first conduit entrance is provided in the upper 60% of the maximum depth of the molten metal in the container and/or the second conduit exit is provided in the lower 25% of the maximum depth of the molten metal in the container. The flow generator may receive material preferentially from around the periphery of the container and/or direct material towards the centre of the container. The inlet and outlet to the flow generator may be angled downwards towards the container. All of these features improve heat transfer and material circulation within the furnace.

23 Claims, 2 Drawing Sheets

FURNACES AND METHODS OF MELTING

This application is a continuation of U.S. application Ser. No. 10/399,508, filed Aug. 15, 2003 now abandoned, which is a national filing of PCT/GB01/04579, filed Oct. 16, 2001, which claims priority of GB0025413.6, filed Oct. 17, 2000, the disclosure of which is incorporated herein by reference.

This invention concerns improvements in and relating to furnace and methods of melting. In particular, but not exclusively it is concerned with round furnaces and/or start-up methods for melting.

A variety of different furnace types exist. These include different shapes of furnace, different heat input methods, different sizes and different materials for which the furnace is designed. Each of these differences can have a significant impact on the successful design of a furnace and render techniques applicable on one type unsuited to use on another type.

A particular problem with furnaces occurs with those furnaces which are started from cold. In these cases a batch of cold metal to be melted is positioned in the furnace and the heat source is applied. This is frequently a set of burner flames, but whatever the heating source the heat input varies from position to position within the furnace. Thus some parts of the metal melt before others and it takes time to achieve a homogeneous melt. Circulation of already molten metal can be applied, but there is a delay before this can be started and even so the start up time with prior art systems is considerable. This delay effects the overall cycle time and hence the throughput of the furnace and plant economics as a result.

The present invention has amongst its aims the provision of a faster start up cycle for furnaces, particularly those starting from solid metal. The present invention has amongst its aims the provision of an improved furnace design. The present invention has amongst its aims the provision of an improved circulation configuration of molten metal in a furnace and/or a more homogeneous melt.

According to a first aspect of the invention we provide a furnace, the furnace including a container for molten metal the container providing a maximum depth for molten metal within the container, and further including a first conduit connected to the container by an entrance and a second conduit connected to the container by an exit, the first conduit providing an inlet to a flow generator, the second conduit providing an outlet from the flow generator, wherein the first conduit entrance is provided in the upper 60% of the maximum depth of the molten metal in the container and/or wherein the second conduit exit is provided in the lower 25% of the maximum depth of the molten metal in the container.

The container may have a periphery adjacent to the walls forming the container and a centre, wherein the first conduit receives molten metal from along the periphery of the container and/or wherein the second conduit directs molten metal towards the centre of the container.

The container may have a centre with the first conduit connected to the container by an entrance portion and the second conduit connected to the container by an exit portion, wherein at least the entrance portion of the first conduit is angled relative to the adjoining part of the container by an angle of less than 30° and/or is angled relative to the centre of the container by an angle of at least 30° and/or wherein at least the exit portion of the second conduit is angled relative to the adjoining part of the container by an angle of at least 60° and/or is angled relative to the centre of the container by an angle of less than 30°.

The molten metal surface may define a plane in use the furnace including a second conduit connected to the container by an exit portion, wherein at least the exit portion of the second conduit is angled downward by an angle of at least 2° relative to the plane of the molten metal surface.

According to a second aspect of the invention we provide a furnace, the furnace including a container for molten metal, the container having a periphery adjacent to the walls for the container and a centre, the furnace further including a first conduit connected to the container and a second conduit connected to the container, the first conduit providing an inlet to a flow generator, the second conduit providing an outlet from the flow generator, wherein the first conduit receives molten metal from along the periphery of the container and/or wherein the second conduit directs molten metal towards the centre of the container.

The furnace container may provide a maximum depth for molten metal within the container, with the first conduit connected to the container by an entrance and the second conduit connected to the container by an exit, wherein the first conduit entrance is provided in the upper 60% of the maximum depth of the molten metal in the container and/or wherein the second conduit exit is provided in the lower 25% of the maximum depth of the molten metal in the container.

The container may have a centre with the first conduit connected to the container by an entrance portion and the second conduit connected to the container by an exit portion, wherein at least the entrance portion of the first conduit is angled relative to the adjoining part of the container by an angle of less than 30° and/or is angled relative to the centre of the container by an angle of at least 30° and/or wherein at least the exit portion of the second conduit is angled relative to the adjoining part of the container by an angle of at least 60° and/or is angled relative to the centre of the container by an angle of less than 30°.

The molten metal surface may define a plane in use, the furnace including a second conduit connected to the container by an exit portion, wherein at least the exit portion of the second conduit is angled downward by an angle of at least 2° relative to the plane of the molten metal surface.

According to a third aspect of the invention we provide a furnace, the furnace including a container for molten metal the container having a centre, the furnace further including a first conduit connected to the container by an entrance portion and a second conduit connected to the container by an exit portion, the first conduit providing an inlet to a flow generator, the second conduit providing an outlet from the flow generator, wherein at least the entrance portion of the first conduit is angled relative to the adjoining part of the container by an angle of less than 30° and/or is angled relative to the centre of the container by an angle of at least 30° and/or wherein at least the exit portion of the second conduit is angled relative to the adjoining part of the container by an angle of at least 60° and/or is angled relative to the centre of the container by an angle of less than 30°.

The furnace container may provide a maximum depth for molten metal within the container, with the end of the first conduit entrance being provided in the upper 60% of the maximum depth of the molten metal in the container and/or with the end of the second conduit exit being provided in the lower 25% of the maximum depth of the molten metal in the container.

The container may have a periphery adjacent to the walls forming the container and a centre, wherein the first conduit receives molten metal from along the periphery of the container and/or wherein the second conduit directs molten metal towards the centre of the container.

The molten metal surface may define a plane in use, the furnace including a second conduit connected to the container by an exit portion, wherein at least the exit portion of the second conduit is angled downward by an angle of at least 2° relative to the plane of the molten metal surface.

According to a fourth aspect of the invention we provide a furnace, the furnace including a container for molten metal, the molten metal surface defining a plane in use, the furnace fisher including a first conduit connected to the container and a second conduit connected to the container by an exit portion, the first conduit providing an inlet to a flow generator, the second conduit proving an outlet form the flow generator, wherein at least the exit portion of the second conduit is angled downward by an angle of at least 2° relative to the plane of the molten metal surface.

The furnace container may provide a maximum depth for molten metal within the container, with the first conduit connected to the container by an entrance and the second conduit connected to the container by an exit, wherein the first conduit entrance is provided in the upper 60% of the maximum depth of the molten metal in the container and/or wherein the second conduit exit is provided in the lower 25% of the maximum depth of the molten metal in the container.

The container may have a periphery adjacent to the walls forming the container and a centre, wherein the first conduit receives molten metal from along the periphery of the container and/or wherein the second conduit directs molten metal towards the centre of the container.

The container may have a centre with the first conduit connected to the container by an entrance portion and the second conduit connected to the container by an exit portion, wherein at least the entrance portion of the first conduit is angled relative to the adjoining part of the container by an angle of less than 30° and/or is angled relative to the centre of the container by an angle of at least 30° and/or wherein at least the exit portion of the second conduit is angled relative to the adjoining part of the container by an angle of at least 60° and/or is angled relative to the centre of the container by an angle of less than 30°.

The first and/or second and/or third and/or fourth aspects of the invention may further include any of the following possibilities, features and options.

The furnace is preferably a circular furnace. The furnace preferably includes a container, which accommodates the molten metal in use, and a lid. The lid is preferably removable. The furnace may be defined by a floor and one or more walls. The furnace may be provided with a wall or wall portion which is inclined relative to the vertical. This wall or wall portion may define a lip to the container and/or in part define an opening in the furnace.

The container is preferably defined by a floor and one or more walls. Preferably all walls and surfaces of the container are refractory lined. The maximum width of the container may be between 8 and 15 times the maximum depth of molten metal.

The maximum depth of molten metal in the container may be substantially the same, for instance +/−2%, over at least 50% of its area. Preferably the floor of the container is sloping. The maximum depth may be determined by a feature of the container, such as the height of part of the wall defining the perimeter of the container and/or the amount of metal charged to the furnace.

The container periphery may be that area or volume of the container which is the outermost 20%.

The container walls may be vertical at least for part of the perimeter of the container, preferably for at least 75% of the perimeter. The container wall may be inclined for the remainder of the perimeter, for instance at 30° to the horizontal.

The molten metal is preferably predominantly aluminum. Other elements and/or additives may be introduced to the molten metal whilst in the furnace. A charge of between 10 and 150 tonnes may be introduced to the furnace.

The first conduit is preferably a pipe. Preferably the cross-section is the same throughout its length. Preferably the first conduit is linear. Preferably the first conduit has a circular cross-section. The first conduit may be of ceramic. The first conduit preferably passes through a wall of the container, preferably a refractory lined wall. The first conduit may include a manifold for connecting it to a further conduit which leads to the flow generator.

The second conduit is preferably a pipe. Preferably the cross-section is the same throughout its length. Preferably the second conduit is linear. Preferably the second conduit has a circular cross-section. The second conduit may be of ceramic. The second conduit preferably passes through a wall of the container, preferably a refractory lined wall. The second conduit may include a manifold for connecting it to a further conduit which leads to the flow generator.

The flow generator may be a mechanical pump. Preferably the flow generator is an electromagnetic pump. Preferably the flow generator is detachable from the furnace.

Particularly with regard to the first aspect of the invention, it is preferred that both the first conduit entrance is provided in the upper 60% of the maximum depth and that the second conduit exit is provided in the lower 25% of the maximum depth.

Particularly with regard to the first aspect of the invention, the first conduit entrance may be provided within the upper 10% to 60% of the maximum depth and more preferably in the upper 25% to 60% and ideally in the upper 40% to 60%.

Particularly with regard to the first aspect of the invention, the second conduit exit may be provided within lower 10% to 25% of the maximum depth.

Particularly with regard to the first aspect of the invention, the reference to the location at which the first conduit entrance and/or second conduit exit are provided may refer to the point at which the middle of the entrance and/or exit are provided.

Particularly with regard to the second aspect of the invention, the first conduit preferably receives molten metal preferentially from the periphery relative to other parts of the container. The periphery may be the outer 15% of the container. Preferably the first conduit receives molten metal from the periphery from one side of the entrance to the first conduit preferentially to molten metal from the other side of the entrance to the first conduit. The molten metal may flow along the periphery to the first conduit in preference to flowing from the centre of the container. Along may refer to substantially parallel flow to the container wall adjoining the entrance to the first conduit.

Particularly with regard to the second aspect of the invention, the second conduit preferably directs molten metal towards the centre of the container preferentially relative to other parts of the container. The centre may be the 20% of the container volume furthest from a wall of the container, preferably other than the floor of the container. Preferably the second conduit directs molten metal towards one side of the centre in preference to the other side. The molten metal may flow from the second conduit towards the centre of the container in preference to flowing along the periphery of the container.

Particularly with regard to the third aspect of the invention, the centre of the container may be a or the location which has the greatest level for its minimum separation from the periphery of the container, particularly the side walls, excluding the container floor. The centre may be the centre of a circular cross-section or cross-section of at least 300° arc extent. The centre may be a point or an axis. The centre may be a point on the floor of the container.

Particularly with regard to the third aspect of the invention, the entrance portion may be the portion of the first conduit which leads directly from the container, preferably the end portion of the second conduit. The entrance portion may be or include the end 10 cm of the first conduit. The entrance portion may be linear. The entrance portion may have a circular cross-section.

Particularly with regard to the third aspect of the invention, the exit portion may be the portion of the second conduit which leads directly to the container, preferably the end portion of the second conduit. The exit portion may be or include the end 10 sm of the second conduit. The exit portion may be linear. The exit portion may have a circular cross-section.

Particularly with regard to the third aspect of the invention, the angle of the entrance portion of the first conduit relative to the adjoining part of the container may refer to an axis of the entrance portion and/or a wall of the entrance portion. The angle of the entrance portion of the first conduit relative to the adjoining part of the container ray refer to a plane defined by the wall of the container and/or the surface of the container adjoining the first conduit. The angle is preferably measured in a horizontal plane.

Particularly with regard to the third aspect of the invention, the first conduit entrance portion and adjoining container part preferably define an angle of less than 25°. The angle is most preferably between 15° and 30°.

Particularly with regard to the third aspect of the invention, the angle of the entrance portion of the first conduit relative to the centre of the container may refer to an axis of the entrance portion and/or a wall of the entrance portion. The angle of the entrance portion of the first conduit relative to the centre of the container may refer the centre as defined above. The angle is preferably measured in a horizontal plane.

Particularly with regard to the third aspect of the invention, the fit conduit entrance portion and centre of the container preferably define an angle of between 30° and 60°. The angle is most preferably between 30° and 45'.

Particularly with regard to the third aspect of the invention, the angle of the exit portion of the second conduit relative to the adjoining part of the container may refer to an axis of the exit portion and/or a wall of the exit portion. The angle of the exit portion of the second conduit relative to the adjoining part of the container may refer to a plane defined by the wall of the container and/or the surface of the container adjoining the second conduit. The angle is preferably measured in a horizontal plane.

Particularly with regard to the third aspect of the invention, the second conduit exit portion and adjoining container part preferably define an angle of at least than 70°. The angle is most preferably between 60° and 120°.

Particularly with regard to the third aspect of the invention, the angle of the exit portion of the second conduit relative to the centre of the container may refer to an axis of the exit portion and/or a wall of the exit portion. The angle of the exit portion of the second conduit relative to the centre of the container may refer the centre as defined above. The angle is preferably measured in a horizontal plane.

Particularly with regard to the third aspect of the invention, the second conduit exit portion and centre of the container preferably define an angle of between 0° and 25°. The angle is most preferably between 5' and 25°.

Particularly with regard to the third aspect of the invention, the angles for the first and second conduits may be measured in the same direction or the alternate direction, but are preferably measured in the same plane.

Particularly with regard to the fourth aspect of the invention, reference to angled downward preferably refers to a direction away from the plane and towards the floor of the container.

Particularly with regard to the fourth aspect of the invention, preferably the angle, relative to the plane of the molten metal surface, is between 2° and 10°, more preferably between 4° and 6°.

According to a fifth aspect of the invention we provide a circulation system for molten metal the system including a flow generator, a first conduit connected to the flow generator and a second conduit connected to the flow generator, the end portion of the first conduit distal to the flow generator having an end face defined by a surface which is non-perpendicular relative to the axis of the end part of the first conduit and/or the end portion of the second conduit distal to the flow generator having an end face defined by a surface which is non-perpendicular relative to the axis of the end part of the second conduit, the first and second conduit end portions being different from one another.

The flow generator and/or first conduit and/or second conduit and/or portions thereof may be provided as detailed elsewhere in this document, including the first and/or second and/or third and/or fourth aspects of the invention.

The end portion of the first conduit may be defined in part, for instance one direction, by a radius or curve, in particular the radius or curve of the peripheral wall of the furnace with which the end face of the first conduit is to form a flush surface.

The end portion of the first conduit may be defined in part by the non-perpendicular angle between the axis of the first conduit and the part of the surface of the peripheral wall of the furnace with which the end face of the first conduit is to form a flush surface.

The end portion of the first conduit may be defined, at least in part, by a curve of radius between 200 and 450 cm. The end portion of the first conduit may be defined, at least in part, by an angle of between 50° and 85° between the end face, or a part thereof, and the axis of the first conduit.

The end portion of the second conduit may be defined in part, for instance one direction, by a radius or curve, in particular the radius or curve of the peripheral wall of the furnace with which the end face of the second conduit is to form a flush surface.

The end portion of the second conduit may be defined in part by the non-perpendicular angle between the axis of the second conduit and the part of the surface of the peripheral wall of the furnace with which the end of the second conduit is to form a flush surface.

The end portion of the second conduit may be defined, at least in part, by a curve of radius between 200 and 450 cm. The end portion of the second conduit may be defined, at least in part, by an angle of between 0° and 40° between the end face, or a part thereof, and the axis of the first conduit. An angle of between 5° and 30° is preferred.

According to a sixth aspect of the invention we provide a method of melting metal, the method including introducing a mass of solid metal to a ice and introducing heat to the furnace to at least partially melt the metal, the furnace including a container for molten metal, the container providing a maximum depth for molten metal within the container, the furnace further including a first conduit connected to the container by an entrance from the first conduit and a second conduit connected to the container by an exit from the second conduit, the first conduit providing an inlet to a flow generator, the second conduit providing an outlet form the flow generator, the first conduit entrance being provided in the upper 60% of the maximum depth of the molten metal in the container and/or the second conduit exit being provided in the lower 25% of the maxim depth of the molten metal in the container, the flow generator moving molten metal through itself via the inlet and outlet conduits.

According to a seventh aspect of the invention we provide a method of melting metal, the method including introducing a mass of solid metal to a furnace and introducing heat to the furnace to at least partially melt the metal, the furnace including a container for molten metal, the container having a periphery adjacent to the walls forming the container and a centre, the furnace further including a first conduit connected to the container and a second conduit connected to the container, the first conduit providing an inlet to a flow generator, the second conduit providing an outlet form the flow generator, the flow generator moving molten metal through itself via the inlet and outlet conduits, the first conduit receiving molten metal from along the periphery of the container and/or the second conduit directing molten metal towards the centre of the container.

According to an eighth aspect of the invention we provide a method of melting metal, the method including introducing a mass of solid metal to a furnace and introducing heat to the furnace to at least partially melt the metal, the furnace including a container for molten metal the container having a centre, the furnace further including a first conduit connected to the container by an entrance portion and a second conduit connected to the container by an exit portion, the first conduit providing an inlet to a flow generator, the second conduit providing an outlet form the flow generator, at least the entrance portion of the first conduit being angled relative to the adjoining part of the container by an angle of less than 30° and/or being angled relative to the centre of the container by a angle of at least 30° and/or at least the exit portion of the second conduit being angled relative to the adjoining part of the container by an angle of at least 60° and/or being angled relative to the centre of the container by an angle of less than 30°, the flow generator moving molten metal through itself via the inlet and outlet conduits.

According to a ninth aspect of the invention we provide a method of melting metal, the method including introducing a mass of solid metal to a furnace and introducing heat to the furnace to at least partially melt the metal, the furnace including a container for molten metal the molten metal surface defining a plane, the furnace further including a first conduit connected to the container and a second conduit connected to the container by an exit portion, the first conduit providing an inlet to a flow generator, the second conduit providing an outlet form the flow generator, at least the exit portion of the second conduit being angled downward by an angle of at least 2° relative to the plane of the molten metal surface, the flow generator moving molten metal through itself via the inlet and outlet conduits.

The sixth, seventh, eighth and ninth aspects of the invention may include any of the features, options or possibilities set out elsewhere in this document, including the following.

The mass of solid metal is preferably lowered into the furnace from above. Preferably the lid is withdrawn to facilitate metal introduction. Preferably the lid is returned after the metal has been charged. Preferably heat is only applied with the lid in position. The heat may be introduced by one or more burners. Preferably the burners are spaced around the periphery of the furnace. Preferably the metal is removed from the furnace once fully molten and/or after any other process steps have been performed. The method may include the addition of one of more materials to the melt or the solid metal. The method may include the casting or producing by other means of a solid metal item from the molten metal produced.

The methods preferably cause molten metal to be withdrawn from the furnace from its periphery, ides in the upper part of the melt. The methods preferably cause molten metal to be introduced to the furnace towards its centre, ideally in the lower part of the melt. Preferably the method causes flow of molten metal from the inlet, across the floor of the container, up the walls of the container and along the periphery of the container in the upper part of the melt to the inlet.

Various embodiments of the invention will now be described, with reference to the accompanying drawings in which: —

Some designs of furnace are started from cold during their melt cycle, this is particularly true of circular furnaces. In basic terms the body of metal to be melted, frequently aluminum, is lifted from its storage location and introduced into the furnace. Most circular furnaces have a removable lid to facilitate this stage. The body of metal, which may be 100 tonnes or more, rests on the floor of the furnace. Heat is then applied, usually from a number of burners positioned around the periphery of the furnace. The fact that these burners are closer to some parts of the furnace interior than others and the fact that the flames are pointed at some parts of the furnace rather than others leads to higher melting rates at some locations than others. Problems also occur as the surface of the melt receives more heat than the bottom of the melt and hence a non-homogeneous melt is common, with consequential problems.

To increase heat transfer and hence melt the material faster and achieve a better melt circulation of the already molten material can be applied in certain circumstances. As the metal has a very high viscosity when initially melted, a consistency reminiscent of treacle, it is unsuited to circulation by conventional pumping and is prone to freezing in any pumping equipment if not moved quickly. The result is that the melt cycle takes a considerable period of time to advance to the fully molten stage. This reduces the throughput of a furnace of any given size and hence impacts on the economics of the plant. Even then accumulation of cooler more viscous metal at the bottom of the furnace, away from the heaters is common.

The invention aims to provide a circulation configuration and method which is able to provide circulation which is less prone to freezing and gives better heat transfer once circulation has started. The overall result is a reduction in cycle time for the furnaces, from cold to molten, of around 10%. This has an immense benefit of productivity and hence income for a plant.

Figure 1:
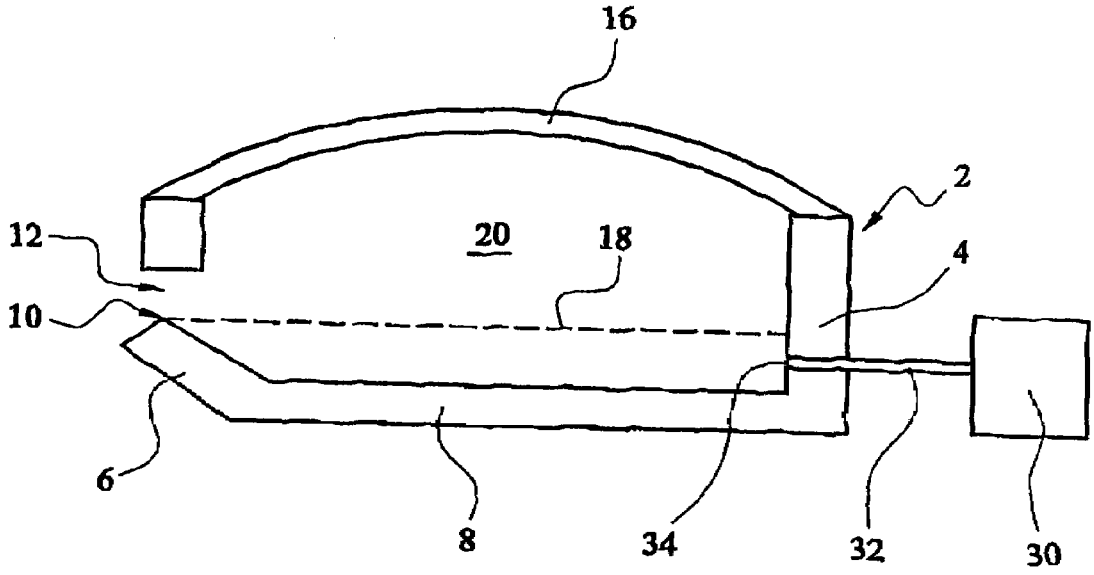
FIG. 1 is a side sectional view of a furnace embodying the present invention and showing the inlet configuration for the circulation system.

As illustrated in FIG. 1 the invention is being deployed on a circular furnace, a furnace design for which it is particularly beneficial. The furnace 2 includes vertical side wall 4 which extends around much of the circumference (approx 300° arc) and a sloping wall 6 which leads upward from the floor 8 of the furnace 2 to a lip 10. The lip 10 defines the bottom of an opening 12 which is used for oxide removal and other steps.

The walls 4, 6 and floor 10 are refractory lined 14. The top of the furnace 2 is closed off by a lid 16.

To load the furnace 2 the lid 16 is slid back and the metal to be melted is lowered in and rested on the floor 8 of the furnace 2. The lid 16 is then returned to seal the opening and heating is started.

Once fully molted the molten metal takes on a maximum level corresponding to the lip 10 height, as identified by level line 18, within the furnace interior 20.

Once heating starts the metal charge will slowly begin to melt. The molten metal, which is highly viscous to start with will flow to the floor 8 and collect. As heating progresses the level of molten metal increases. The top part of the melt receives the most heat and hence is decreased in viscosity. The applicant has also established that the metal at the sides of the furnace tends to be hotter than at the centre.

The present invention achieves circulation by a pumping unit 30 positioned outside the furnace and connected to the furnace interior by an inlet and outlet pipe. The inlet pipe 32 is shown in FIG. 1 and is positioned around halfway between the floor 8 and the level line 18. The inlet pipe 32 is angled downward towards the furnace interior 20 at an angle of around 1.0°. This assists drainage of molten material back into the furnace 2 should the furnace be emptied for any reason. The inlet pipe 32 is of ceramic and has a furnace end 34 which is flush with the wall 4.

By providing the inlet pipe 32 at this height the pumping unit 30 is always provided with hot molten metal from within the furnace 2. This eliminates problems with freezing of previously molten metal in the pumping unit 30.

Figure 2:
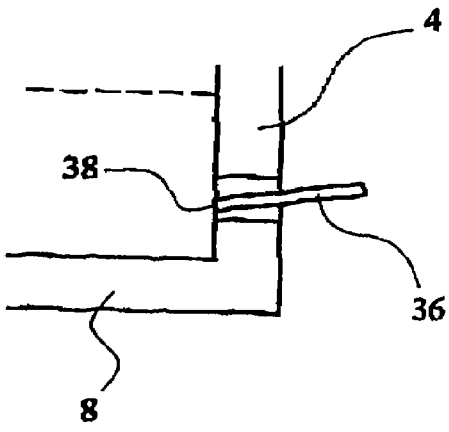
FIG. 2 is a side sectional view of a the furnace of FIG. 1 showing the outlet configuration for the circulation system.

The outlet pipe 36 is shown in FIG. 2 and has a different position. The outlet pipe 36 is positioned close to the floor 8. Once again the outlet pipe 36 is also angled downward towards the furnace interior, but this time at a much steeper angle, around 5°. This provides not only for gravity drainage, if needed, but significantly encourages the molten metal exiting the outlet pipe 36 to flow vigorously across the floor 8 and hence transfer heat to the cooler metal which has accumulated there. As with the inlet pipe 32, the outlet pipe 36 is of ceramic and has an end 38 flush with the interior of the wall 4 of the furnace 2. The end 38 of the outlet pipe 36 is provided at around 15% of the distance between the floor 8 and level line 18.

Figure 3:
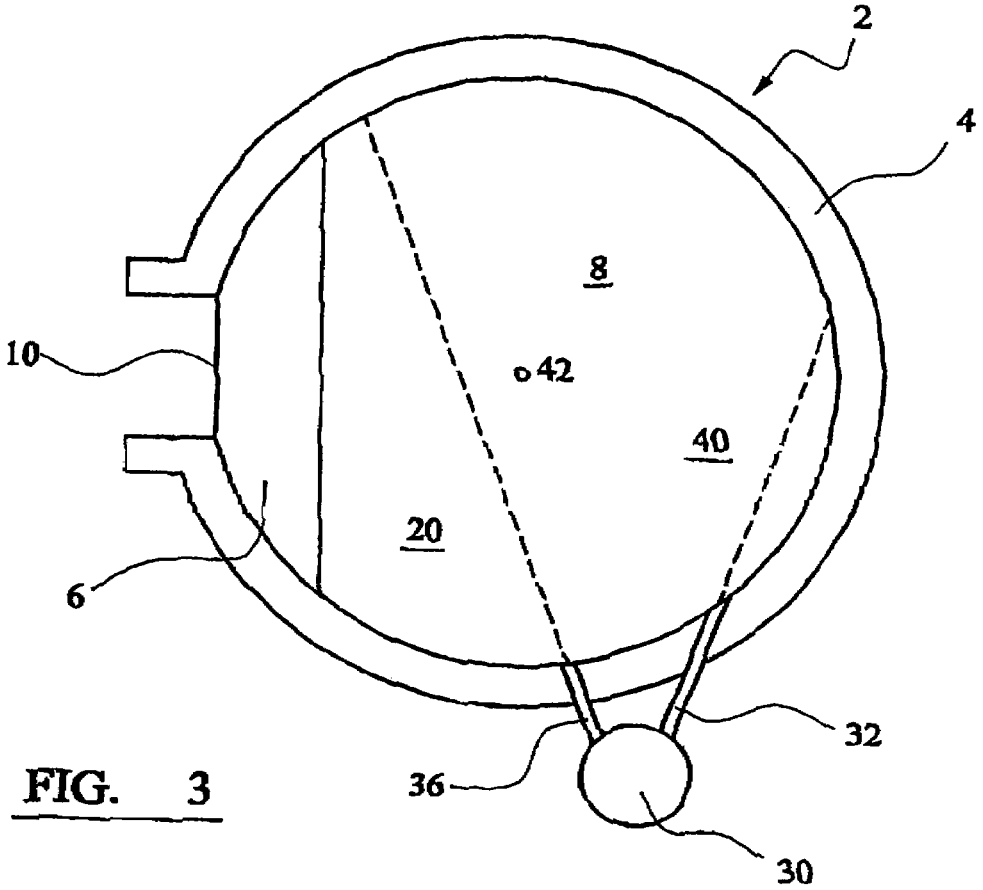
FIG. 3 is a sectional plan view of the furnace of FIGS. 1 and 2 showing the inlet and outlet configuration.

As well as the vertical positioning of the inlet and outlet pipes 32, 36, being carefully designed, the horizontal configuration is also carefully provided, as shown in FIG. 3. In the plan view of FIG. 3, once again the furnace 2, vertical wall 4, sloping wall 6, floor 8 and lip 10 are shown.

The inlet pipe 32 is carefully arranged so that it draws molten metal from around the edge of the furnace 2, location 40. As this location 40 is closer to the peripheral burners, not shown, it is hotter than the centre 42, even at the top. This means that the pumping unit is drawing in the hottest metal available to circulate. Again problems with freezing in the pumping unit are reduced still further as a result.

The outlet pipe 36 is also carefully arranged, in this case to feed the hot molten metal towards the centre 42 of the furnace interior 20. As a result the hottest metal is sent to the centre bottom of the fun-ace to contact the coolest location and hence metal in the furnace.

The overall effect is to eliminate freezing problems, such as blockages or restrictions, in the pumping unit 30 and pipes 32, 36, by always passing the hottest metal through the unit 30. Additionally, the hottest metal is circulated to the location where the coolest metal collects and hence heat transfer to this metal is maximised, whilst the flow paths which result encourage movement even of this cooler material.

Figure 4:
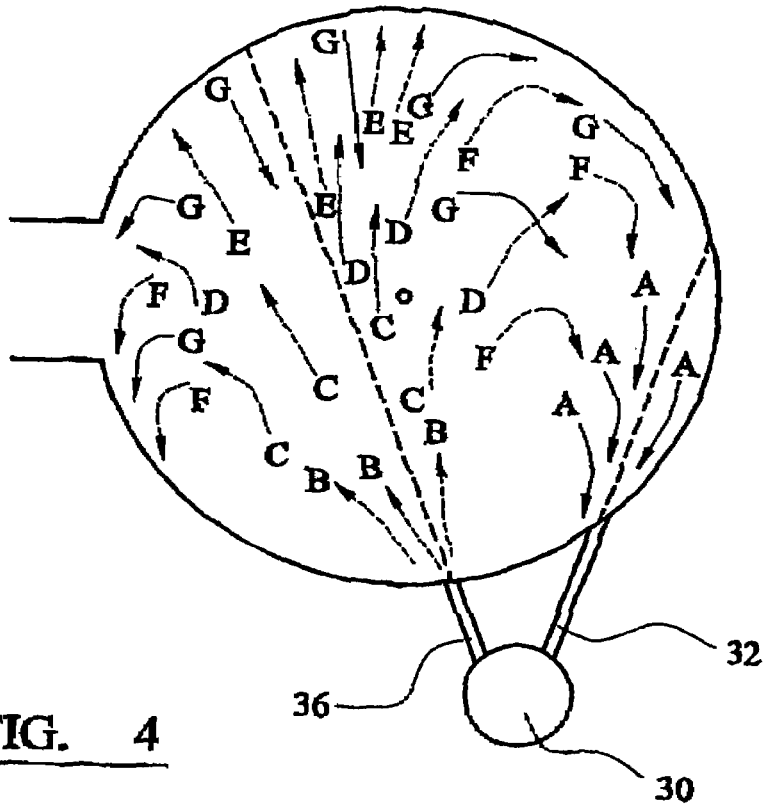
FIG. 4 is a schematic plan view showing the circulation of molten metal within the furnace of FIG. 1.

The benefits can be further appreciated from consideration of the flow paths illustrated in FIG. 4, schematically. The metal at the top periphery 60 of the melt is hottest as it is exposed to the burners by being on top and receives the most heat due to physical proximity with the heaters. This metal, arrow A, is drawn into the inlet pipe 32 and hence through pump 30 before passing out through outlet pipe 36, at the bottom and heading for the centre of the furnace interior 20, arrow B. The solid arrows of FIG. 4, such as arrow A, are indicative of surface flow; the dotted arrows of FIG. 4, such as a arrow B, are indicative of bottom flow. Arrow B flow spreads out across the floor 8, arrows C, resulting in hot metal contacting any cool metal which accumulates here initially (thus heating it) and/or encouraging flow from this location, arrows D. The flow through the pumping unit is sufficient to generate upward flow at the walls, arrows E; circulating flow at the bottom, arrows F and circulating flow at the top, arrows G. The result is good heat transfer between the hot material and the cold and the promotion of flow throughout the furnace interior 20 rather than allowing quiet cool locations to form. Melting is thus quicker, evening out of heat within the melt is thus quicker and the evening out of heat is more even than in prior art systems.

Whilst a variety of mechanical pump systems can be used to achieve the circulation described above, the technique is particularly suited to the use of electromagnetic pumping technology. Electromagnetic pumping uses magnetic repulsion to propel a conductor, the molten metal, through the unit. Strong electromagnets are used around a refractory tube to achieve the effect. The technique is particularly suited to the present invention as it can be operated-easily at a variety of flow rates to accommodate the amount of pumpable metal available as start up proceeds; is less prone to freezing than mechanical pumps and, most importantly can achieve far higher flow rates than mechanical pumps which gives optimised circulation. Electromagnetic pumping can be used to pump 10 tonne of metal per minute or more.

The invention claimed is:

1. A furnace, the furnace including a container for molten metal, the container having a periphery, the container providing a maximum depth for molten metal within the container, and further including a first conduit connected to the container by an entrance portion and a second conduit connected to the container by an exit portion, the first conduit providing an inlet to a flow generator, the second conduit providing an outlet from the flow generator, wherein:

the furnace is a circular furnace, the container having a centre;

the first conduit entrance is provided in the upper 60% of the maximum depth of the molten metal in the container and/or wherein the second conduit exit is provided in the lower 25% of the maximum depth of the molten metal in the container;

and the first conduit entrance portion is angled relative to the adjoining part of the periphery of the container by an angle of less than 30°.

2. A furnace according to claim 1 in which the container has a periphery adjacent to the walls forming the container and a centre, wherein the first conduit receives molten metal from along the periphery of the container and/or wherein the second conduit directs molten metal towards the centre of the container.

3. A furnace according to claim 1 in which the container has a centre with the first conduit connected to the container by an entrance portion and the second conduit connected to the container by an exit portion, wherein at least the exit portion of the second conduit is angled relative to the adjoining part of the container by an angle of at least 60° and or is angled relative to the centre of the container by an angle of less than 30°.

4. A furnace according to claim 1 in which the molten metal surface defines a plane in use, the furnace including a second conduit connected to the container by an exit portion, wherein at least the exit portion of the second conduit is angled downward by an angle of at least 2° relative to the plane of the molten metal surface.

5. A furnace according to claim 1 in which the flow generator is an electromagnetic pump.

6. A furnace according to claim 1 in which the first conduit entrance is provided within the upper 40% to 60% of the maximum depth.

7. A furnace according to claim 1 in which the second conduit exit is provided within lower 10% to 25% of the maximum depth.

8. A furnace according to claim 1 in which the first conduit receives molten metal preferentially from the periphery relative to other parts of the container, the periphery being the outer 15% of the container volume.

9. A furnace according to claim 1 in which the first conduit receives molten metal from the periphery from one side of the entrance to the first conduit preferentially to molten metal from the other side of the entrance to the first conduit.

10. A furnace according to claim 1 in which the second conduit directs molten metal towards the centre of the container preferentially relative to other parts of the container, the centre being the 20% of the container volume furthest from a wall of the container other than the floor of the container.

11. A furnace according to claim 1 in which the second conduit directs molten metal towards one side of the centre in preference to the other side.

12. A furnace according to claim 1 in which the first conduit entrance portion and adjoining of the periphery of the container part define an angle of between 15° and 30°.

13. A furnace according to claim 1 in which the first conduit entrance portion and centre of the container define an angle of between 30° and 45°.

14. A furnace according to claim 1 in which the second conduit exit portion and adjoining part of the periphery of the container part define an angle of between 60° and 120°.

15. A furnace according to claim 1 in which the second conduit exit portion and centre of the container define an angle of between 5° and 25°.

16. A method of melting metal, the method including introducing a mass of solid metal to a furnace and introducing heat to the furnace to at least partially melt the metal, the furnace including a container for molten metal, the container having a periphery, the container providing a maximum depth for molten metal within the container, the furnace further including a first conduit connected to the container by an entrance from the first conduit and a second conduit connected to the container by an exit from the second conduit, the first conduit providing an inlet to a flow generator, the second conduit providing an outlet from the flow generator, the first conduit entrance being provided in the upper 60% of the maximum depth of the molten metal in the container and or the second conduit exit being provided in the lower 25% of the maximum depth of the molten metal in the container, the first conduit entrance portion being angled relative to the adjoining part of the periphery of the container by an angle of less than 30°, the flow generator moving molten metal through itself via the inlet and outlet conduits.

17. A method of melting metal, the method including introducing a mass of solid metal to a furnace and introducing heat to the furnace to at least partially melt the metal, the furnace including a container for molten metal, the container having a periphery adjacent to the walls forming the container and a centre, the furnace further including a first conduit connected to the container and a second conduit connected to the container, the first conduit providing an inlet to a flow generator, the first conduit entrance portion being angled relative to the adjoining part of the periphery of the container by an angle of less than 30°, the second conduit providing an outlet from the flow generator, the flow generator moving molten metal through itself via the inlet and outlet conduits, the first conduit receiving molten metal from along the periphery of the container and/or the second conduit directing molten metal towards the centre of the container.

18. A method of melting metal, the method including introducing a mass of solid metal to a furnace and introducing heat to the furnace to at least partially melt the metal, the furnace including a container for molten metal, the container having a centre, the furnace further including a first conduit connected to the container by an entrance portion and a second conduit connected to the container by an exit portion, the first conduit providing an inlet to a flow generator, the second conduit providing an outlet from the flow generator, at least the entrance portion of the first conduit being angled relative to the adjoining part of the container by an angle of less than 30° and at least the exit portion of the second conduit being angled relative to the adjoining part of the container by an angle of at least 60° and/or being angled relative to the centre of the container by an angle of less than 30°, the flow generator moving molten metal through itself via the inlet and outlet conduits.

19. A method of melting metal, the method including introducing a mass of solid metal to a furnace and introducing heat to the furnace to at least partially melt the metal, the furnace including a container for molten metal, the container having a periphery, the molten metal surface defining a plane, the furnace further including a first conduit connected to the container and a second conduit connected to the container by an exit portion, the first conduit providing an inlet to a flow generator, the first conduit entrance portion being angled relative to the adjoining part of the periphery of the container by an angle of less than 30°, the second conduit providing an outlet from the flow generator, at least the exit portion of the second conduit being angled downward by an angle of at least 2° relative to the plane of the molten metal surface, the flow generator moving molten metal through itself via the inlet and outlet conduits.

20. A method according to claim 16 in which the methods cause molten metal to be withdrawn from the furnace from its periphery.

21. A method according to claim 16 in which the methods cause molten metal to be introduced to the furnace towards its center.

22. A method according to claim 16 in which the method causes flow of molten metal from the inlet, across the floor of the container, up the walls of the container and along the periphery of the container in the upper part of the melt to the inlet.

23. The furnace of claim 1 wherein the container further comprises a floor and the floor having a shape.

* * * * *